US007251421B2

(12) United States Patent
Yoshizuka et al.

(10) Patent No.: US 7,251,421 B2
(45) Date of Patent: Jul. 31, 2007

(54) IMAGE FORMING APPARATUS FOR PERFORMING CALIBRATION WITHOUT REDUCING THROUGHPUT IN PRINTING

(75) Inventors: Ken Yoshizuka, Nagano-ken (JP); Keiichi Taguchi, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 140 days.

(21) Appl. No.: 11/133,467

(22) Filed: May 20, 2005

(65) Prior Publication Data

US 2006/0008285 A1 Jan. 12, 2006

(30) Foreign Application Priority Data

May 20, 2004 (JP) ..... 2004-150451

(51) Int. Cl.
*G03G 15/00* (2006.01)
*G03G 15/01* (2006.01)

(52) U.S. Cl. ..... 399/43; 399/9; 399/27; 399/49; 399/53; 399/227

(58) Field of Classification Search ..... 399/49, 399/27, 9, 43, 53, 119, 120, 258, 262, 227; 347/19

See application file for complete search history.

(56) References Cited

U.S. PATENT DOCUMENTS 5,950,036 A * 9/1999 Konishi ..... 399/43 X
2004/0136025 A1* 7/2004 Moriyama et al. ..... 399/9 X
2005/0207790 A1* 9/2005 Yamada et al. ..... 399/227

FOREIGN PATENT DOCUMENTS

| | | | |
|---|---|---|---|
| JP | 2000-015896 | A | 1/2000 |
| JP | 2002-229278 | A | 8/2002 |
| JP | 2002-351190 | A | 12/2002 |
| JP | 2003-316106 | A | 11/2003 |

* cited by examiner

*Primary Examiner*—Sophia S. Chen
(74) *Attorney, Agent, or Firm*—Sughrue Mion, PLLC

(57) ABSTRACT

The image forming apparatus has an image supporting body, a developing device on which developing units storing developers of the same color are detachably mounted, and control unit for controlling a printing operation in response to a print request. Further, in the case where the total number of print pages of a first developing unit, which is in use, exceeds the number of calibration pages if executing a print request, when a second developing unit which does not exceed the number of calibration pages exists, the control unit executes the printing operation using the second developing unit, and when the second developing unit does not exist, the control unit executes the printing operation using the first developing unit if the requested print page number does not exceed a predetermined threshold, or executes a calibration operation if the requested print page number exceeds the predetermined threshold.

10 Claims, 6 Drawing Sheets

MODIFIED EXAMPLE 1

MODIFIED EXAMPLE 2

IMAGE FORMING APPARATUS FOR PERFORMING CALIBRATION WITHOUT REDUCING THROUGHPUT IN PRINTING

BACKGROUND OF THE INVENTION

1. Field of the Invention

The present invention relates to an image forming apparatus which forms an image by using an electronic printing technology, and particularly to an image forming apparatus which has a plurality of developing units for storing developers of the same color, and which performs calibration by means of a pattern of patches without reducing throughput in printing.

2. Description of the Related Art

An image forming apparatus which forms an image by using an electronic printing technology is provided in a printer, facsimile, copier and the like, and comprises an image supporting body (photoconductor drum) in which an electrostatic latent image is formed in accordance with image data, a charging unit for charging an external surface of the image supporting body, an exposure unit for exposing the external surface of the charged image supporting body in accordance with the image data to form the electrostatic latent image, a developing device for feeding a toner as a developer to the image supporting body to develop the electrostatic latent image of the image supporting body into a toner image, and a transfer unit for transferring the toner image to a medium as a target for transfer.

The developing device detachably holds the developing units containing a plurality of color toners or toners of the same color, and brings an appropriate developer proximate to the image supporting body in accordance with the developing timing. The developing device therefore has a developing rotary which is subjected to rotation control. When performing color printing, a plurality of color toners, e.g. four colors of developing units (yellow Y, magenta M, cyan C, and black K), are mounted on the developing rotary, and these developing units are sequentially brought proximate to the image supporting body to develop each color.

On the other hand, there has been suggested to mount the plurality of developing units of the same color all together, e.g. black, on the developing rotary of the developing device to obtain an image forming apparatus for black-and-white printing. Examples are shown in Japanese Patent Application Laid-Open Nos. 2002-351190 (published on Dec. 4, 2002) and 2003-316106 (published on Nov. 6, 2003). In this image forming apparatus for black-and-white printing, a plurality of black developing units can be mounted, thus, even when performing a large amount of black-and-white printing, frequency of replacing the developing units can be reduced by sequentially using the plurality of developing units.

In an image forming apparatus where an electrophotographic technology is used, an image supporting body (photoconductor drum) is charged to a predetermined bias potential, an exposure beam of a predetermined strength is emitted to the image supporting body to form a latent image, and a toner is transferred from a developing unit by means of the bias potential difference between the developing unit and the image supporting body. Therefore, how the toner is transferred differs according to control parameters such as the bias potential between the developing unit and image supporting body, the exposure strength and the like. Further, even with the same control parameter, how the toner is transferred differs along with a change in the external environment, an increase in the number of usages of the developing unit, replacement of the developing unit, and the like. How the toner is transferred has an affect on the concentration of a development pattern. Therefore, in general, calibration is performed appropriately in which a predetermined pattern of patches is formed on the image supporting body by means of a toner, and an optimum control parameter is determined in accordance with the optical concentration of the pattern of patches.

SUMMARY OF THE INVENTION

The condition of the toner changes according to the history of electrostatic charge, along with an increase of the number of print pages using the developing unit, thus calibration using the above-described pattern of patches is required. Therefore, commonly, a calibration operation is executed on the developing unit which is used for a predetermined number of print pages, to update a control parameter to an adequate value. However, such a calibration operation requires a certain number of operation steps and time, such as exposure, development, detection of the optical concentration of the pattern of patches, and the like. Therefore, if the calibration operation is executed in the middle of a print request made by a user, the printing is discontinued, thereby causing a decrease in printing throughput.

An object of the present invention therefore is to avoid a decrease in printing throughput and to provide an image forming apparatus for performing calibration by means of a pattern of patches.

In order to achieve the above object, according to a first aspect of the present invention, the image forming apparatus comprises an image supporting body in which a latent image is formed, a developing device on which a plurality of developing units storing developers of the same color are detachably mounted, and control unit for controlling a printing operation in response to a print request in which the developers of the developing units are transferred to the latent image of the image supporting body to perform development. Further, in the case where the total number of print pages of a first developing unit, which is in use, exceeds the number of calibration pages if executing a print request, when a second developing unit which does not exceed the number of calibration pages exists, the control unit of the image forming apparatus executes the printing operation using the second developing unit, and when the second developing unit which does not exceed the number of calibration pages does not exist, the control unit executes the printing operation using the first developing unit if the requested print page number does not exceed a predetermined threshold, executes a calibration operation if the requested print page number exceeds the predetermined threshold and executes a post-printing operation. By executing the printing operation of a print request using any of the plurality of developing units, with avoiding calibration as much as possible, discontinuation of printing due to calibration can be avoided as much as possible, whereby printing throughput can be improved.

In a preferred embodiment of the above-described first aspect, even in the case where the second developing unit which does not exceed the number of calibration pages exists, a printing operation is executed using the first developing unit in use if the requested print page number does not exceeds the predetermined threshold, and if the requested print page number exceeds the predetermined threshold, the printing operation is executed using the second developing unit as described above. Even in the case where the second developing unit can be used, if the requested print page number is small, the printing operation is performed with the first developing unit without switching the developing units, whereby the time required for switching the developing units can be saved, and printing throughput can be improved.

In order to achieve the above-described object, a second aspect of the present invention is an image forming apparatus, comprising an image supporting body in which a latent image is formed, a developing device on which a plurality of developing units storing developers of the same color are detachably mounted, and control unit for controlling a printing operation in response to a print request in which the developers of the developing units are transferred to the latent image of the image supporting body to perform development, and for controlling a calibration operation in which a pattern of patches is developed on the image supporting body to perform calibration, wherein in the case where the number of calibration pages of a first developing unit, which is in use, is exceeded if the printing operation of the print request is executed, when there exists a second developing unit in which the number of calibration pages is not exceeded, the control unit executes the printing operation using the second developing unit, and in the case in which there does not exist the second developing unit where the number of calibration pages is not exceeded, the control unit executes the printing operation using the first developing unit if the number of print pages of the print request does not exceed a predetermined threshold, and executes the calibration operation if the predetermined threshold is exceeded, and execute a post-printing operation.

In a preferred embodiment of the second aspect of the present invention, even in the case where there exists the second developing unit where the number of calibration pages is not exceeded, the control unit executes the printing operation using the first developing unit if the number of requested print pages does not exceed the predetermined threshold, and executes the printing operation using the second developing unit if the predetermined threshold is exceeded.

DESCRIPTION OF THE PREFERRED EMBODIMENTS

Hereinbelow, embodiments of the present invention are described with reference to the drawings. However, the technical scope of the present invention is not limited to these embodiments, but ranges to the items described in the claims and the equivalents thereof.

Figure 1:
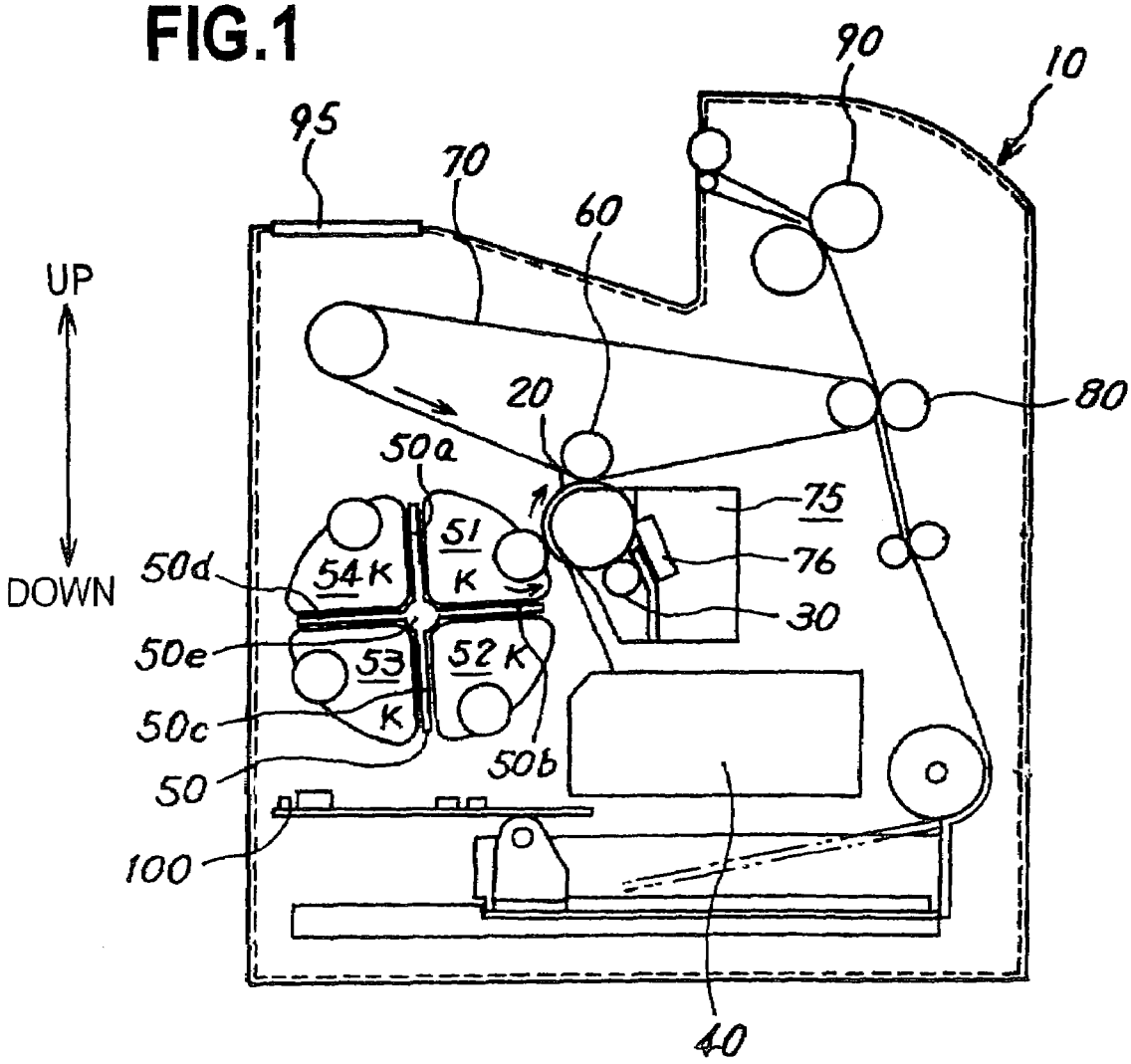
FIG. 1 is a main configuration diagram of the image forming apparatus according to the present embodiment.

FIG. 1 is a main configuration diagram of the image forming apparatus according to the present embodiment. In the present embodiment, a laser-beam printer 10 is used as an example of the image forming apparatus. A printer 10 in FIG. 1 shows a configuration of a black-and-white print mode.

The printer 10 comprises a charging unit 30, exposure unit 40, developing device 50, primary transfer unit 60, intermediate transfer body 70, and cleaning unit 75, along a rotation direction of a photoconductor drum 20 which is an image supporting body for supporting a latent image. Further, the printer 10 comprises a secondary transfer unit 80, fixing unit 90, display unit 95 for outputting various information items to a user, and a control unit 100 for controlling these units.

The photoconductor drum 20 has a cylindrical conductive substrate and a photosensitive layer formed on an external surface thereof, can be rotated with respect to the central axis, and is rotated clockwise as shown by the arrow. The charging unit 30 evenly charges the external surface of the photoconductor drum 20. The exposure unit 40 irradiates the charged photoconductor drum 20 with an illuminant beam, such as a built-in laser, LED array, or the like, to form an electrostatic latent image. Beam irradiation of the exposure unit 40 is controlled by a driving signal which is modulated based on image information inputted from a host computer.

The developing device 50 is a developing rotary which can be rotated with respect to a central axis 50*e*, and mount portions 50*a* to 50*d* thereof are detachably mounted with developing units 51 to 54 containing toners as developers. The developing device 50 is rotated to bring any of the necessary developing units 51 to 54 proximate to the photoconductor drum 20, and charged developers are fed to the photoconductor drum 20 by means of the bias potential difference between the developing unit and the image supporting body, whereby the latent image is developed to an image obtained by the developers.

In the example of FIG. 1, the developing units 51 to 54 containing black developers only are mounted on the mount portions 50*a* to 50*d* of the developing device 50, and the print mode is black-and-white print mode. In a black-and-white printing process, development is carried out using a developer of the any four developing units. Further, if developing units, each of which contains a developer of black K, cyan C, magenta M, and yellow Y, are mounted on the mount portions 50*a* to 50*d* of the developing device 50, the print mode is a color print mode. In a color printing process, formation of a latent image and development using each developer are performed on the photoconductor drum 20 in the order of CMYK. Therefore, the developing device 50 is rotated clockwise to bring an appropriate color of developing unit proximate to the photoconductor drum 20 to sequentially perform development for every latent image formation and development process of each color.

The primary transfer unit 60 transfers a toner image formed on the photoconductor drum 20 to the intermediate transfer body 70. The intermediate transfer body 70 is an endless belt obtained by forming an aluminum evaporation layer on, for example, the surface of a PET film, and forming a semiconductor coating on the obtained surface, and is rotary driven at the same peripheral velocity as the photoconductor drum 20. In the color print mode, image of CMYK are transferred to the intermediate transfer body 70 in a laminated fashion. In the black-and-white print mode, an image of single color is transferred to the intermediate transfer body 70. The secondary transfer unit 80 transfers the toner image formed on the intermediate transfer body 70 to a print medium such as a paper, and the fixing unit 90 fixes the toner image transferred onto the print medium to the medium to obtain a permanent image. The print medium is discharged to the outside the printer.

The cleaning unit 75 is provided between the primary transfer unit 60 and the charging unit 30, and has a cleaning blade 76 abutting on the surface of the photoconductor drum 20 constantly. The developer (toner) remaining on the photoconductor drum 20 after the first transfer is removed by the cleaning blade 76. The removed developer is accumulated in the cleaning unit 75 having the cleaning blade 76.

Each of the developing units 51 to 54 is detachable to the developing device 50, and is provided with a storage medium, e.g. noncontact nonvolatile memory, for storing color information, information on the remaining amount of developers, information of the number of print pages on the past, and the like such that the printer can recognize the condition of the mounted developing units. Further, after the power is started up, or after the developing units are mounted on the developing device, the information in the nonvolatile memories of the developing units is read out. In addition, the information on the remaining amount of developers and the information on the number of print pages are updated to the nonvolatile memories of the developing units after development.

As shown in FIG. 1, once the developing units 51 to 54 for a color black are mounted on all of the mount positions of the developing device 50, the color information is read from the nonvolatile memories of the four developing units, and the control unit 100 judges that the print mode is the black-and-white print mode. Moreover, when the CMYK developing units are mounted on the mounting positions of the developing device 50, the color information is read from the nonvolatile memories of the four developing units in a similar way, and the control unit 100 judges that the print mode is the color print mode. In either print mode, the amount of developers used at the time of printing is obtained, and the information on the remaining amount of toner of each developing unit is updated on the basis of the amount of developers used, and kept in each nonvolatile memory.

Figure 2:
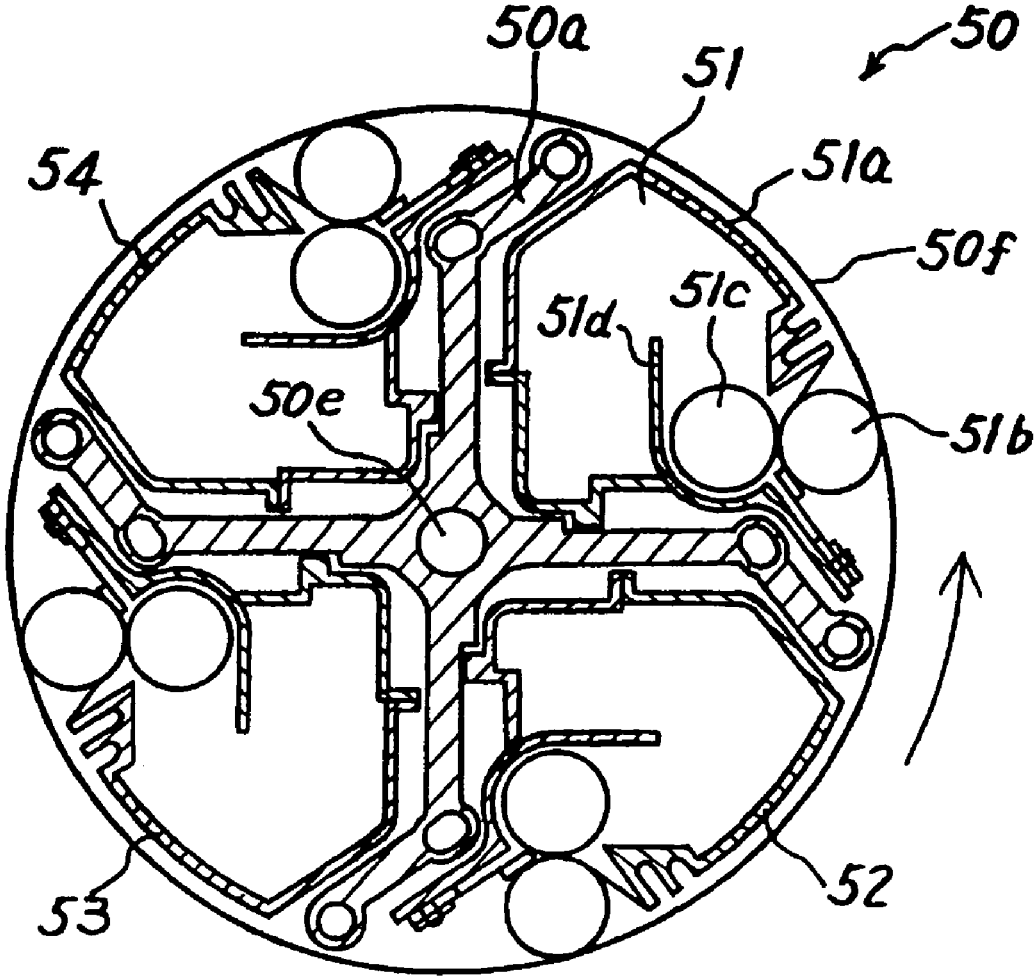
FIG. 2 is a cross sectional view showing a detailed structure of a developing device 50.

FIG. 2 is a cross sectional view showing a detailed structure of the developing device 50. The developing device 50 detachably mounts the plurality of developing units 51 to 54 in the space between a housing 50*f* and the mount portion 50*a* rotated with respect to the central axis 50*e* as the center. The plurality of developing units all have the same structure. For example, the developing unit 51 is equipped with a container 51*a*, developing roller 51*b*, feed roller 51*c*, and partition plate 51*d*. The developing roller 51*b* and the feed roller 51*c* are rotatably attached to the container 51*a*, and are rotated by a motor, which is not shown, when the developing units are brought proximate to the photoconductor drum 20. The feed roller 51*c* is rotated by being welded to the developing roller 51*b* with pressure, whereby the surrounding toners are subjected to abrasion charge, and the charged toners are fed to the photoconductor drum 20 via the developing roller 51*b*. The partition plate 51*d* is provided such that it surrounds the feed roller 51*c*, and divides a toner-containing space inside the container 51*a* into right and left. By providing the partition plate 51*d*, the toners in the space on the feed roller 51*c* side are fed to the developing roller 51*b* side by welding rotations of the feed roller 51*c* and the developing roller 51*b*. Moreover, when the developing device 50 is rotated 90 degrees counterclockwise twice, i.e. 180 degrees, the developing device 50 is positioned in the developing unit 53, and the toners inside the containing space on the feed roller 51*c* side are mixed at the upper part of the partition plate 51*d* with the toners in the containing space on the side opposite to the feed roller 51*c*. When the developing device 50 is further rotated 90 degrees, the mixed toners are stirred and freshened. When the developing device 50 is further rotated 90 degrees, some of the toners that are stirred and freshened are stored in the containing space on the feed roller 51*c* side. In this manner, since the toner-containing space is divided by providing the partition plate 51*d* and the feed roller is provided in one side in the toner-containing space, the toners which are subjected to abrasion charge are stirred and freshened by the rotations of the developing device 50.

Figure 3:
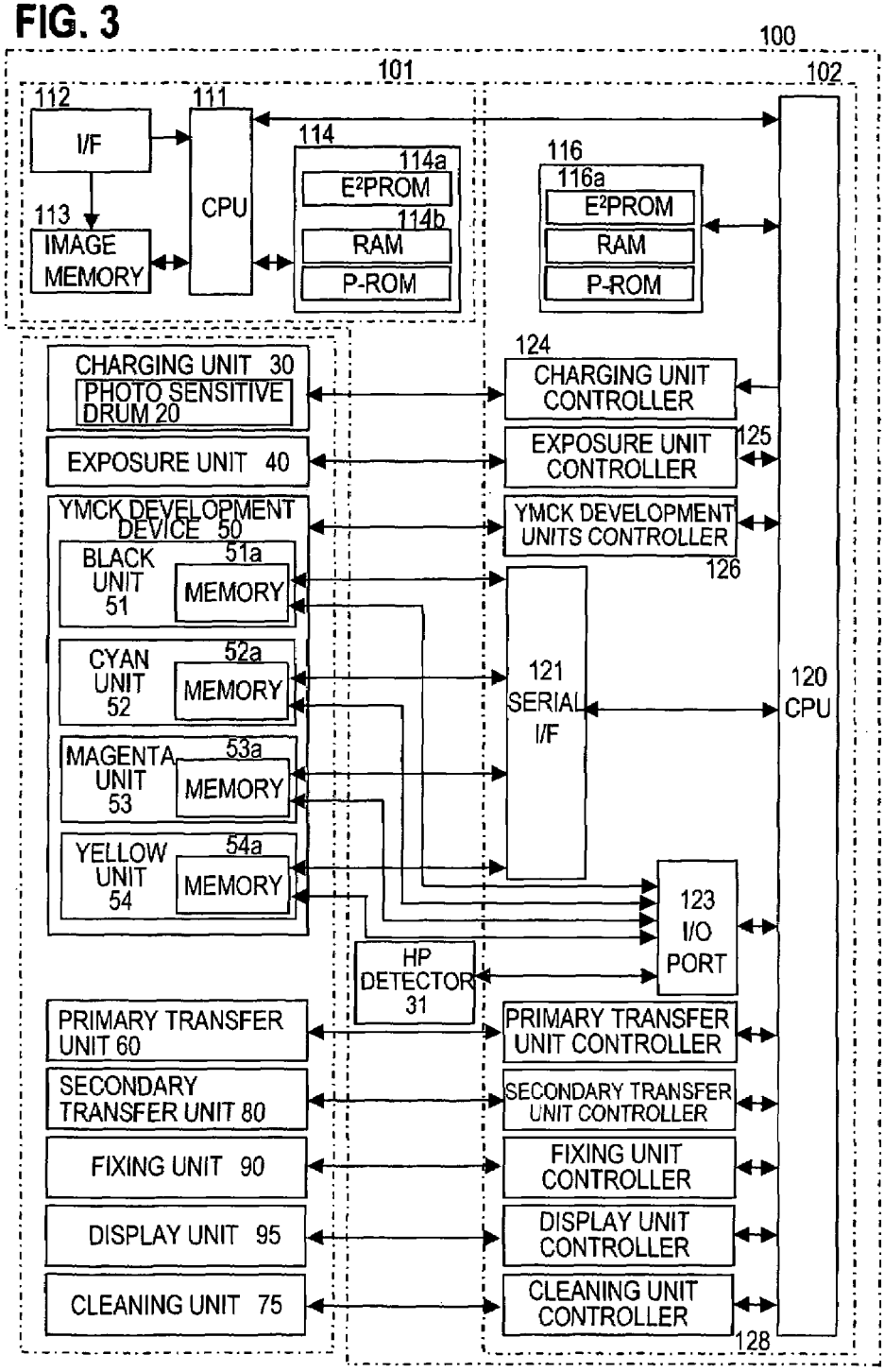
FIG. 3 is a block diagram of a control unit 100 according to the present embodiment.

FIG. 3 is a block diagram of the control unit 100 according to the present embodiment. The control unit 100 as the control means is supplied with print job data from the host computer to perform predetermined image processing, generates a control signal and an image signal to an engine, and comprises a main controller 101 which performs display control on a display panel 95, and an engine controller 102 which controls each unit of the print engine. The main controller 101 comprises an interface 112 which receives the print job data from the host computer, an image memory 113 which stores image data present in the print job data, a CPU 11 which performs image processing such as half tone processing, setting and auto-detect of a display mode, display control of a display panel and the like, and a memory unit 114 having a nonvolatile memory 114*a*, and RAM, ROM 114*b*. Print mode information which indicates whether the printer is in the color print mode or black-and-white print mode is stored in the nonvolatile memory 114*a*. The print mode is judged by the main controller 101 in accordance with the color information from the memories of the developing units mounted on the developing device when the power is ON. The judged print mode information is written into the nonvolatile memory 114*a*.

Moreover, the engine controller 102 comprises, in addition to a CPU 120, a memory unit 116, serial interface 121, input/output port 123, drive control circuits 124, 125 and 126 which drive the charging unit 30, exposure unit 40, developing device 50 respectively, and a drive control circuit group 128 which drive the primary transfer unit 60, secondary transfer unit 80, fixing unit 90, display unit 95, and cleaning unit 75 respectively. Further, a detection portion 31 for detecting a home position of the developing device 50 is provided. The engine controller 102 is supplied from the main controller 101 with a control signal for controlling printing process and an image signal for controlling irradiation of an exposure beam, and controls each unit.

In addition, the developing units 51 to 54 mounted on the developing device 50 have developing unit side memories 51*a* to 54*a* respectively. These memories are constituted by nonvolatile memories such as FeRAM, EEPROM and the like, and store color information of the developers, information on the remaining amount of developers, ID information of the developing units, information on the number of print pages developed by the developing units on the past. When the power is ON or when a developing unit is replaced or additionally mounted, the engine controller 102 accesses these developing unit side memories 51*a* to 54*a* to read whether a developing unit is mounted, the color information, ID information, information on the remaining amount of developers, information on the number of print pages on the past, and the like. Further, during the development process, the information on the remaining amount of developers or the information on the number of print pages on the past is updated to the memory of the developing unit in which the development process is finished.

In a nonvolatile memory 116*a* in the memory unit 116, stored being information on whether or not the developing units are mounted on the four mounting positions in the developing device, the color information of the mounted developing units, ID information, information on the remaining amount of developers, information on the number of print pages on the past, and the like. Further, the nonvolatile memory 116*a* has stored therein a control parameter for engine control, control parameter (exposure strength, charge potential value etc.) corresponding to each developing unit, color or black-and-white print mode information, and the like. The memory unit 116 is provided with a program ROM and RAM. An engine control program, calibration control program and the like are stored in the program ROM. The CPU 120 refers to the control parameter of the nonvolatile memory 116*a* to execute the engine control program, thereby executing a normal printing operation. In a predetermined time of calibration, the CPU 120 executes the calibration control program to perform a calibration operation by means of a pattern of patches using a predetermined developing unit, and update the control parameter in accordance with the calibration result thus obtained.

In the present embodiment, the control unit 100, preferably the engine controller 102 performs calibration by means of a pattern of patches in order to optimize the control parameter in the exposure process or the development process. This control parameter includes an exposure strength from the exposure unit 40 and a bias potential from the charging unit 30. A latent image is formed on the photoconductor drum 20 and development is performed by means of the toner which is the developer, on the basis of these control parameters. When the exposure strength and the bias potential increase, the optical concentration of the developed toner image is raised, and vice versa. Furthermore, when the developer and structure of the developing unit, the history of electrostatic charge of the developer, the characteristics of the photoconductor drum 20, the surrounding environment (temperature, humidity) and the like are different, the optical concentration of the toner image changes even with the same control parameter. Therefore, calibration by means of a pattern of patches is performed in a predetermined circumstance so that the same optimum optical concentration can be recreated even for any photoconductor drum, developing unit, and history of electrostatic charge in any environment. In the calibration operation, a latent image of a predetermined pattern of patches is formed on the photoconductor drum in the exposure process, the latent image is then developed in the development process, the optical concentration of the developed pattern of patches is detected, and the control parameter is determined based on this optical concentration. This control parameter is determined in accordance with each developing unit, and stored in the nonvolatile memory 116*a* on the main body side.

In order to keep the optical concentration of the developed toner image optimum, the time that calibration is performed is (1) when turning the power ON, (2) when the photoconductor drum 20 as the image supporting body is replaced, (3) when a developing unit is replaced or newly mounted, (4) when the number of print pages on the past reaches a predetermined number of calibration pages in the developing unit, or other time. When the power is turned on, it is for obtaining a control parameter corresponding to the use environment. When the photoconductor drum 20 is replaced, it is for determining an exposure strength parameter and the like that are suitable for the characteristics of the replaced photoconductor drum. When a developing unit is replaced or newly mounted, it is for determining a bias potential parameter and the like that are suitable for the developing unit. Finally when the number of print pages on the past reaches a predetermined number of calibration pages in the developing unit, it is for determining an optimum bias potential parameter and the like for the developer having a certain history of electrostatic charge. Calibration is performed in these times.

Consequently, there occurs a problem in which, when a print request is received from the host computer, and when the number of print pages of the print request is printed and thereby reaches the above-described number of calibration pages (4), the printing operation is discontinued or queued by the calibration operation, whereby throughput of the printing operation is reduced. The present embodiment provides an image forming apparatus which performs a calibration operation without causing a decrease in throughput of the printing operation, with taking advantage that a plurality of developing units are mounted on a developing device, in the case of a black-and-white print mode.

Figure 4:
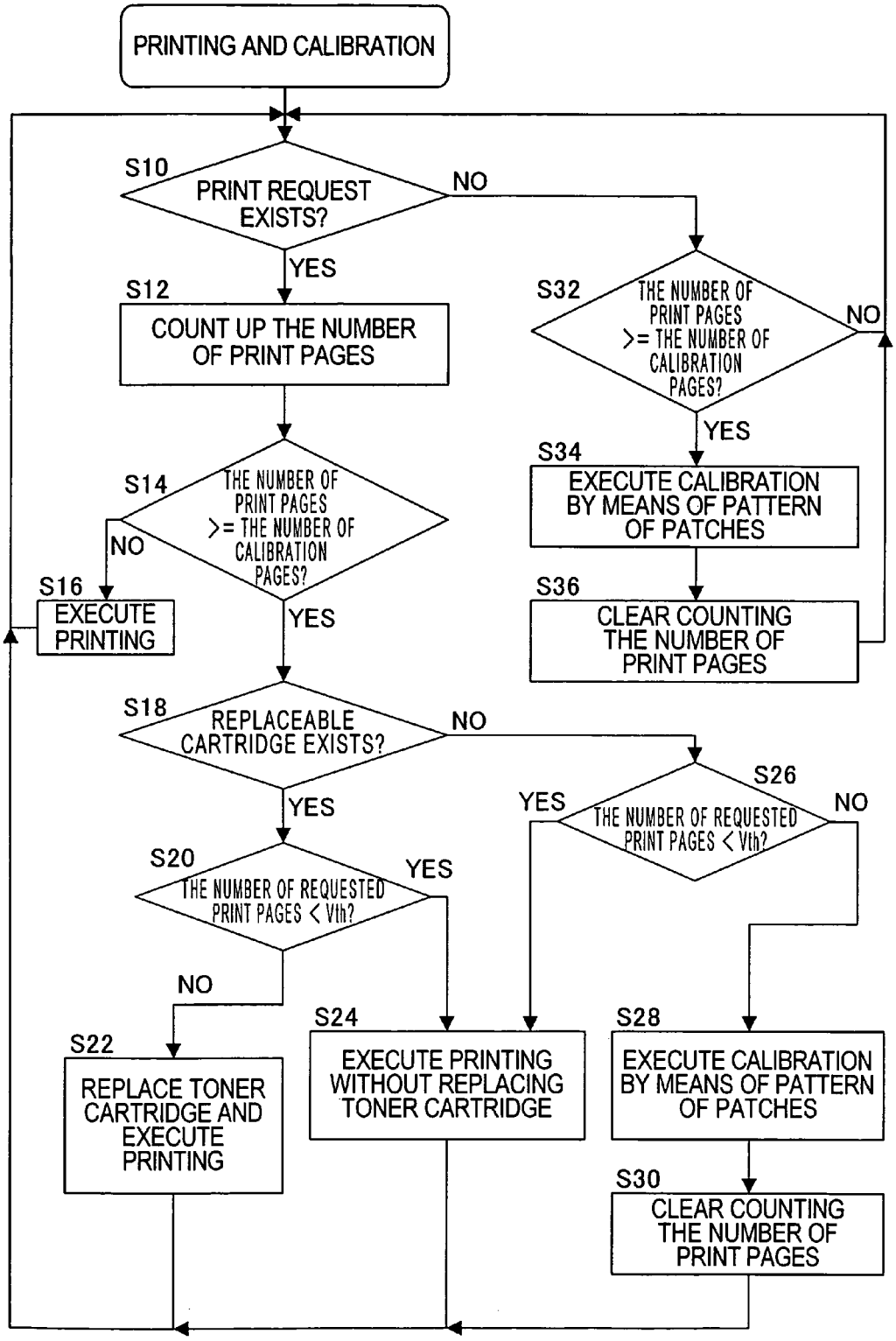
FIG. 4 is a control flow chart in the present embodiment when a printing operation and a calibration operation compete with each other.

FIG. 4 is a control flow chart in the present embodiment when a printing operation and a calibration operation compete with each other. It is assumed that the engine controller 102 performs this control; however, the main controller 101 and the engine controller 102 may perform this control. Also, this control is premised on the situation in which four or a plurality of black developing units are mounted on the developing device, e.g. the black-and-white print mode. In this case, the engine controller 102 stores information on which developing unit is currently in use in the nonvolatile memory 116*a* or the like, and rotates the developing rotary to rotationally transfer the in-use developing unit to a development position.

First of all, when a print job is generated, the main controller 101 performs a predetermined image processing, and a print request is outputted from the engine controller 102 (S10) If there is a print request (YES in S10), the number of print pages on the past in the developing unit, which is currently in use, is counted up (S12). This count-up number may be the number of pages of a print job accepted by a printer, or simply the number of pages in print units, which is outputted from the engine controller. Moreover, the number of print pages on the past is stored in the nonvolatile memories 51*a* to 54*a* of the developing unit or the nonvolatile memory 116*a*. Then, it is checked whether or not the number of print pages which is counted up becomes greater or equal to the number of pages on which calibration should be executed ("the number of calibration pages" hereinafter) (S14). If the calibration pages is not reached (NO in S14), printing is executed using the developing unit which is currently a target for use (S16). As long as there is a print request, printing is repeated by the developing unit which is currently a target for use.

When there is a print request, and when the number of print pages request, which is counted up, becomes greater or equal to the number of calibration pages in the developing unit which is currently in use (YES in S14), the developing unit reaches the number of calibration pages if the print request is executed, whereby the printing operation and the calibration operation compete with each other. Specifically, if the printing operation is continued, the printing operation is performed by a control parameter which is not optimum, whereby deterioration of the image quality may be caused. However, if the calibration operation is prioritized, the printing operation is discontinued or queued, whereby throughput of the printing operation decreases.

Therefore, in the present embodiment, in the case where the counted up number of print pages becomes greater or equal to the number of calibration pages in the developing unit which is currently in use (YES in S14), it is checked if there exists a developing unit in which the number of calibration pages is still not reached (S18). Specifically, it is checked whether or not any another usable developing unit (toner cartridge) which can be replaced with the currently used developing unit exists. If it exists (YES in S18), it is checked whether or not the number of requested print pages which is already accepted currently is less than a predetermined threshold of the number of pages Vth (S20). If the number of requested print pages is greater than or equal to the predetermined threshold of the number of pages Vth (NO in S20), the developing unit is replaced with another usable developing unit, and printing is executed (S22). Accordingly, the accepted print request can be processed preferentially, and further printing is executed using a developing unit on which calibration does not have to be performed, thus deterioration of the quality of the printed image can be avoided. Further, if the number of requested print pages to be executed is less than the predetermined threshold of the number of pages Vth (YES in S20), the developing unit which is currently in use is used to execute printing (S24). The reason is when the number of requested print pages is small, even if the developing unit on which calibration needs to be performed is used, the quality of the printed image is not deteriorated too much, and further it is not necessary to subject the developing rotary to rotation control to replace the developing unit, thus a decrease in printing throughput can be avoided. It should be noted that the engine controller 102 receives, from the main controller 101, information on the number of requested print pages which is already accepted currently, in order to make judgment of the step S20.

Moreover, if there does not exist another developing unit where the number of calibration pages is not reached (NO in S18), it is checked whether or not the number of requested print pages which is already accepted currently is less than the predetermined threshold of the number of pages Vth (S26). If the number of requested print pages to be executed is less than the predetermined threshold of the number of pages Vth (YES in S26), the developing unit which is currently in use is used to execute printing (S24). The reason is when the number of requested print pages is small, even if the developing unit on which calibration needs to be performed is used, the quality of the printed image is not deteriorated too much. On the other hand, if the number of requested print pages exceeds the predetermined threshold of the number of pages Vth, the printing operation is queued, and the calibration operation is executed by means of the pattern of patches (S28). The reason is if the number of requested print pages is large, it is necessary to prioritize the calibration operation in order to avoid deterioration of the quality of the printed image. Then, the control parameter of the developing unit which is currently in use is updated to an optimum value due to the calibration operation. Once the calibration is finished, the information on the number of print pages of the developing unit is cleared (S30).

As described above, since the plurality of developing units of the same color are mounted, even if it is the time to execute calibration on the developing unit which is currently in use, printing job which is already accepted can be executed using another developing unit, as long as there is another usable developing unit. At the time when there no longer exists another usable developing unit (NO in S18), calibration is executed for the developing unit only when the number of requested print pages is large. However, even when there no longer exists another usable developing unit, if the number of requested print pages is small (YES in S26) calibration is postponed, and printing is executed. Consequently, a decrease in printing throughput can be avoided as much as possible. Further, even when there exists other usable developing unit, if the number of requested print pages is small (YES in S20) calibration is postponed, and printing is executed.

If the printing is finished and there is no more print request in time (NO in S10), the postponed calibration operation is executed (S32, S34 and S36). Specifically, by executing the calibration on the developing unit while no print request, whose calibration being postponed as a result of prioritizing printing, a decrease in printing throughput can be avoided to execute the calibration. Execution of this postponed calibration operation (S32, S34 and S36) may be performed in response to that a calibration execution permission is provided from the main controller 101, for example.

In FIG. 4, when it is proven that the in-use developing unit reaches the number of calibration pages in the step S14 (YES in S14), the engine controller may judge first whether the number of requested print pages exceeds the threshold Vth. Specifically, the steps S20 and S26 are judged first. Then, if the number of requested print pages does not exceed the threshold Vth, printing is executed using the developing unit which is currently in use, as in the step S24. On the other hand, if the number of requested print pages exceeds the threshold Vth, judgment is made whether or not it is possible to use another developing unit after replacement (step S18). If possible, the developing unit is replaced with another developing unit, and printing is executed. If it is not possible, the printing is queued and calibration is executed.

Also, in the above case, even when the number of requested print pages does not exceed the threshold Vth, if another developing unit can be used after replacement, the developing unit may be replaced to this new developing unit to execute printing.

MODIFIED EXAMPLE 1

Figure 5:
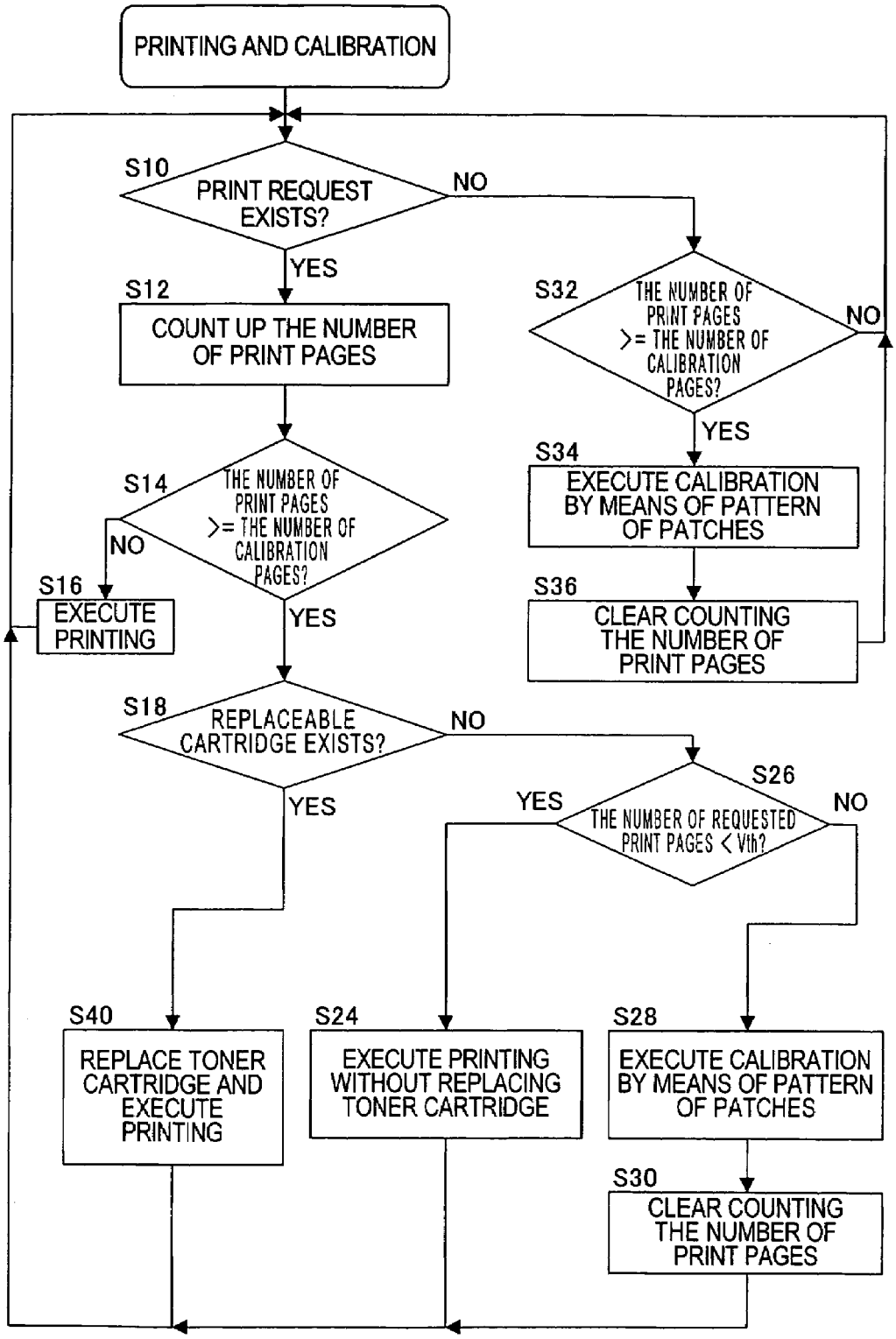
FIG. 5 is a modified example of the control flow chart in the present embodiment when the printing operation and the calibration operation compete with each other.

FIG. 5 is a modified example of the control flow chart in the present embodiment when the printing operation and the calibration operation compete with each other. This control flow chart also is premised on the black-and-white print mode in which a plurality of toner cartridges of the same color are mounted. Further, it is premised that the engine controller 102 performs control; however, the main controller 101 and the engine controller 102 may perform this control.

In this modified example, in the case where the counted up number of print pages becomes greater than or equal to the number of calibration pages (YES in S14), if there exists another replaceable toner cartridge (YES in S18), printing is executed after replacing with another usable toner cartridge regardless of the number of requested print pages (S40). Other operations are same as those in FIG. 4, thus the same reference numbers are provided in each step. Specifically, this modified example is a basic controlling operation in which when calibration needs to be performed for one developing unit, the developing unit is replaced with another developing unit on which calibration does not have to be performed to execute printing, with taking advantage that the plurality of black developing units are mounted all together. Moreover, even in the case in which there does not exists another replaceable and usable developing unit (NO in S18), if the number of requested print pages is less than the threshold of the number of pages, the current developing unit on which calibration needs to be performed is used as is to execute printing, and decrease in printing throughput is minimized as much as possible.

MODIFIED EXAMPLE 2

Figure 6:
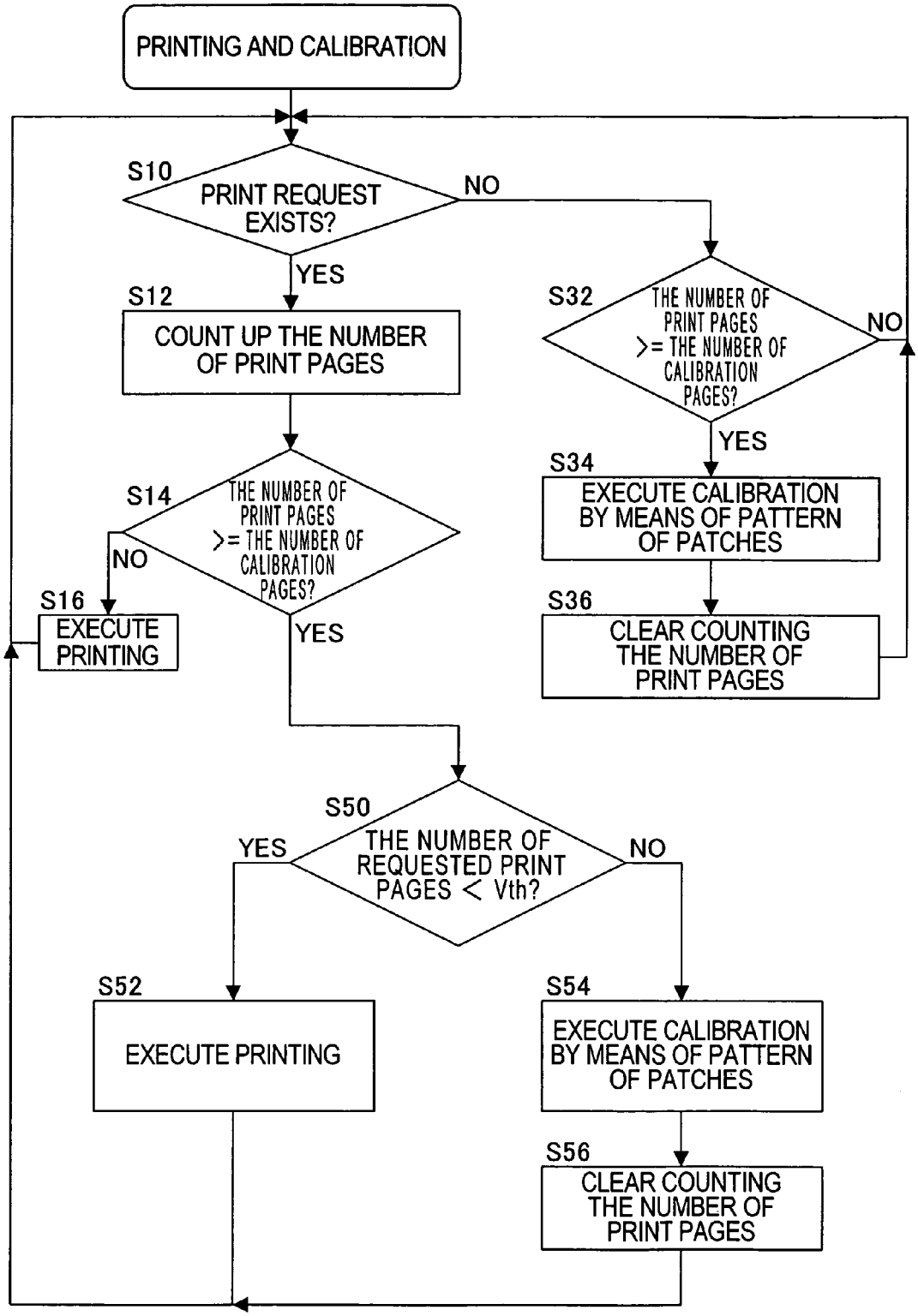
FIG. 6 is a modified example of the control flow chart in the present embodiment when the printing operation and the calibration operation compete with each other.

FIG. 6 is a modified example of the control flow chart in the present embodiment when the printing operation and the calibration operation compete with each other. This control flow chart is premised on the black-and-white print mode in the color print mode in which the CMYK developing units are mounted. Also, similarly to the above description, it is premised that the engine controller 102 performs control; however, the main controller 101 and the engine controller 102 may perform this control.

In the color print mode, when it is the time for any of the CMYK developing units to be subjected to calibration, it is desired to prioritize calibration instead of executing color printing, in order to prevent deterioration of combination colors. On the other hand, in the black-and-white printing in the color print mode, one black developing unit is used to execute the printing operation. In this case, the problem is that the calibration operation and printing operation of the black developing unit compete with each other.

In this modified example, therefore, when number of print pages in the black developing unit becomes greater than or equal to the umber of calibration pages (YES in S14), it is checked whether or not the number of requested print pages is less than the predetermined threshold of the number of pages Vth (S50). If the number of requested print pages is less than the predetermined threshold of the number of pages Vth (YES in S50), the calibration operation is queued, and the printing operation is performed using the black developing unit (S52). The reason is that, since the number of requested print pages is small, printing with the black developing unit does not lead to a decrease in the image quality. Particularly, such printing is accepted since it is not necessary to laminate a plurality of toner images in the black-and-white printing. On the other hand, if the number of requested print pages is greater than or equal to the predetermined threshold of the number of pages Vth (NO in S50), printing is queued to execute calibration (S54). When calibration is executed, the count value of the number of print pages on the past of the black developing unit is cleared (S56). Then, printing is executed after updating the control parameter of the black developing unit to an optimum value (S16).

Furthermore, in this modified example as well, in the case where calibration is queued to prioritize the printing operation, at the time when there no longer exists a print request (NO in S10) or when a calibration permission notification is received from the main controller 101 (not shown), the calibration operation (S32, S34 and S36) is executed.

In the control flow charts of FIGS. 4, 5 and 6, the engine controller 102 makes judgment whether printing is prioritized or calibration is prioritized, on the basis of the information on the number of print pages of the print request which is already accepted, the information being received from the main controller 101. However, this judgment may be performed by the main controller 101, and the main controller 101 may notify the engine controller 102 of a command regarding prioritization.

As above, according to the embodiments, the calibration operation can be executed without causing a decrease in throughput of the printing operation, with taking advantage that the plurality of developing units of the same color are mounted. Furthermore, even in the color print mode, in the case of the black-and-white printing, the calibration operation can be executed without causing a decrease in throughput of the printing operation.

What is claimed is:

1. An image forming apparatus, comprising:

an image supporting body in which a latent image is formed;

a developing device on which a plurality of developing units storing developers of the same color are detachably mounted; and control unit for controlling a printing operation in response to a print request in which the developers of the developing units are transferred to the latent image of the image supporting body to perform development, and for controlling a calibration operation in which a pattern of patches is developed on the image supporting body to perform calibration, wherein in the case where the number of calibration pages of a first developing unit, which is in use, is exceeded when the printing operation of the print request is executed, if there exists a second developing unit in which the number of calibration pages is not exceeded, the control unit executes the printing operation using the second developing unit, and if there does not exist the second developing unit in which the number of calibration pages is not exceeded, the control unit executes the printing operation using the first developing unit if the number of print pages of the print request does not exceed a predetermined threshold, and executes the calibration operation if the number of print pages of the print request exceeds the predetermined threshold, and thereafter executes a post-printing operation.

2. The image forming apparatus according to claim 1, wherein, even in the case where the second developing unit in which where the number of calibration pages is not exceeded, the control unit executes the printing operation using the first developing unit if the number of requested print pages does not exceed the predetermined threshold, and executes the printing operation using the second developing unit if the predetermined threshold is exceeded.

3. The image forming apparatus according to claim 2, wherein one or both of a control parameter of the process in which a latent image is formed on the image supporting body, and a control parameter of the process in which the development is performed is optimized by the calibration operation.

4. The image forming apparatus according to claim 1, wherein one or both of a control parameter of the process in which a latent image is formed on the image supporting body, and a control parameter of the process in which the development is performed is optimized by the calibration operation.

5. An image forming apparatus, comprising:

an image supporting body in which a latent image is formed;

a developing device on which a plurality of developing units storing developers of the same color are detachably mounted; and control unit for controlling a printing operation in response to a print request in which the developers of the developing units are transferred to the latent image of the image supporting body to perform development, and for controlling a calibration operation in which a pattern of patches is developed on the image supporting body to perform calibration, wherein in the case where the number of calibration pages of a first developing unit, which is in use, is exceeded when the printing operation of the print request is executed, if the number of requested print pages does not exceed a predetermined threshold, the control unit uses the in-use first developing unit to execute the printing operation, and if the number of requested print pages exceeds the predetermined threshold, in the case in which there exists a second developing unit where the number of calibration pages is not exceeded, the control unit uses the second developing unit to execute the printing operation, and in the case in which there does not exists the second developing unit where the number of calibration pages is not exceeded, the control unit executes the calibration operation and thereafter executes a post-printing operation.

6. The image forming apparatus according to claim 5, wherein, even in the case where the number of requested print pages does not exceed the predetermined threshold, the control unit uses the first developing unit to execute the printing operation when there does not exist the second developing unit in which the number of calibration pages is not exceeded, and the control unit uses the second developing unit to execute the printing operation when there exists the second developing unit in which the number of calibration pages is not exceeded.

7. The image forming apparatus according to claim 6, wherein one or both of a control parameter of the process in which a latent image is formed on the image supporting body, and a control parameter of the process in which the development is performed is optimized by the calibration operation.

8. The image forming apparatus according to claim 5, wherein one or both of a control parameter of the process in which a latent image is formed on the image supporting body, and a control parameter of the process in which the development is performed is optimized by the calibration operation.

9. An image forming apparatus, comprising:

an image supporting body in which a latent image is formed;

a developing device on which a plurality of developing units storing developers of the same color are detachably mounted; and control unit which controls a printing operation in response to a print request in which the developers of the developing units are transferred to the latent image of the image supporting body to perform development, and controls a calibration operation in which a pattern of patches is developed on the image supporting body to perform calibration, wherein, in the case where it is time to execute calibration to a first developing unit, which is in use, when the printing operation of the print request is executed, if there exists another usable developing unit, the control unit executes the printing operation using the another usable developing unit, and if there does not exist another usable developing unit, the control unit executes the printing operation using the first developing unit if the number of print pages of the print request does not exceed a predetermined threshold, and executes the calibration operation if the number of print pages of the print request exceeds the predetermined threshold, and thereafter executes a post-printing operation.

10. An image forming apparatus, comprising:

an image supporting body in which a latent image is formed;

a developing device on which a plurality of developing units storing developers of the same color are detachably mounted; and control unit which controls a printing operation in response to a print request in which the developers of the developing units are transferred to the latent image of the image supporting body to perform development, and controls a calibration operation in which a pattern of patches is developed on the image supporting body to perform calibration, wherein, in the case where it is time to execute calibration to a first developing unit, which is in use, when the printing operation of the print request is executed, if there exists another usable developing unit, the control unit executes the printing operation using the another usable developing unit, and if there does not exist another usable developing unit, the control unit executes the printing operation using the first developing unit if the number of print pages of the print request is smaller, and executes the calibration operation if the number of print pages of the print request is larger, and thereafter executes a post-printing operation.

* * * * *